US009919980B2

(12) United States Patent
Penney et al.

(10) Patent No.: US 9,919,980 B2
(45) Date of Patent: Mar. 20, 2018

(54) INSENSITIVE MUNITION PROPELLANTS

(71) Applicant: BAE SYSTEMS plc, London (GB)

(72) Inventors: Mark James Penney, Monmouthshire (GB); Anne Marie Wilton, Renfrewshire Strathclyde (GB); Thomas William Delaney Somerville, Renfrewshire Strathclyde (GB)

(73) Assignee: BAE SYSTEMS plc, London (GB)

( * ) Notice: Subject to any disclaimer, the term of this patent is extended or adjusted under 35 U.S.C. 154(b) by 14 days.

(21) Appl. No.: 14/780,412

(22) PCT Filed: Mar. 18, 2014

(86) PCT No.: PCT/GB2014/050848

§ 371 (c)(1),
(2) Date: Sep. 25, 2015

(87) PCT Pub. No.: WO2014/155060

PCT Pub. Date: Oct. 2, 2014

(65) Prior Publication Data

US 2016/0046537 A1 Feb. 18, 2016

(30) Foreign Application Priority Data

Mar. 27, 2013 (EP) ..... 13275082
Mar. 27, 2013 (GB) ..... 1305589.2

(51) Int. Cl.
*C06B 25/00* (2006.01)
*C06B 25/34* (2006.01)
(Continued)

(52) U.S. Cl.
CPC ..... *C06B 25/34* (2013.01); *C06B 45/10* (2013.01); *C06B 45/105* (2013.01)

(58) Field of Classification Search
USPC ..... 149/2, 88, 92, 109.2
See application file for complete search history.

(56) References Cited

U.S. PATENT DOCUMENTS 3,953,259 A 4/1976 Sayles
4,092,188 A 5/1978 Cohen et al.
(Continued)

FOREIGN PATENT DOCUMENTS

DE 102010005923 A1 6/2011
EP 0495714 A1 7/1992
(Continued)

OTHER PUBLICATIONS

International Preliminary Report on Patentability received for Patent Application No. PCT/GB2014/050848, dated Oct. 8, 2015. 7 pages.

(Continued)

*Primary Examiner* — James E McDonough
(74) *Attorney, Agent, or Firm* — Finch & Maloney PLLC

(57) ABSTRACT

The invention relates to Insensitive Munition (IM) energetic materials particularly IM propellant compositions, and yet further to nitrocellulose-free IM propellants.

An energetic composition suitable for use as a propellant comprises the following components in the following relative proportions:

component A; from 5% to 25% by weight of an IM energetic filler;

component B: from 50% to 80% by weight of a highly energetic filler comprising at least one nitramine compound;

component C of from 5% to 20% by weight of a binder; and component D of from 3% to 15% by weight of a plasticizer;

the percentages by weight of components A, B, C and D together with minor additives, if any, adding to 100%.

21 Claims, 1 Drawing Sheet

(51) Int. Cl.

| | |
|---|---|
| ***C06B 45/10*** | (2006.01) |
| *D03D 23/00* | (2006.01) |
| *D03D 43/00* | (2006.01) |

(56) References Cited

U.S. PATENT DOCUMENTS

| | | | | |
|---|---|---|---|---|
| 4,116,734 | A | 9/1978 | Perrault et al. | |
| 4,289,551 | A | 9/1981 | Perrault et al. | |
| 4,379,007 | A | 4/1983 | Fifer et al. | |
| 4,919,737 | A | 4/1990 | Biddle et al. | |
| 5,034,072 | A | 7/1991 | Becuwe | |
| 5,034,073 | A | 7/1991 | Barry et al. | |
| 5,529,649 | A | 6/1996 | Lund et al. | |
| 6,228,190 | B1 | 5/2001 | Debenham | |
| 6,692,655 | B1 | 2/2004 | Martins et al. | |
| 6,833,037 | B1 | 12/2004 | Hallam et al. | |
| 7,211,140 | B1 | 5/2007 | Mertz et al. | |
| 7,857,920 | B1 * | 12/2010 | Mason | C06B 45/10 149/104 |
| 2002/0003016 | A1 | 1/2002 | Ampleman et al. | |
| 2005/0115652 | A1 | 6/2005 | Augier et al. | |
| 2011/0284140 | A1 * | 11/2011 | Muller | C06B 25/20 149/64 |
| 2016/0052836 | A1 | 2/2016 | Penney et al. | |

FOREIGN PATENT DOCUMENTS

| | | | |
|---|---|---|---|
| FR | 2691963 | A1 | 12/1993 |
| GB | 964001 | | 7/1964 |
| GB | 1554636 | | 10/1979 |
| GB | 2264942 | A | 9/1993 |
| GB | 2265896 | A | 10/1993 |
| GB | 2371297 | A | 7/2002 |
| JP | 2008110892 | A | 5/2008 |
| WO | 9935108 | A1 | 7/1999 |
| WO | 2009131563 | A1 | 10/2009 |
| WO | 2010023450 | A1 | 3/2010 |
| WO | 2014155060 | A1 | 10/2014 |
| WO | 2014155061 | A1 | 10/2014 |

OTHER PUBLICATIONS

International Search Report and Written Opinion received for Patent Application No. PCT/GB2014/050849, dated Apr. 17, 2014. 12 pages.

International Preliminary Report on Patentability received for Patent Application No. PCT/GB2014/050849, dated Oct. 8, 2015. 8 pages.

GB Intellectual Property Office Search Report under Section 17(5) received for GB Patent Application No. 1305590.0 dated Sep. 30, 2013. 3 pages.

Extended European Search Report received from EP Patent Application No. 13275081.1 dated Sep. 6, 2013. 8 pages.

Erythropel, et al., "Designing green plasticizers: Influence of molecular geometry on biodegradation and plasticization properties," Chemosphere, Feb. 2012. Elsevier Ltd GBR, vol. 86, No. 8. pp. 759-766.

Rahman, M. and Brazel, C.S., "The plasticizer market: An assessment of traditional plasticizers and research trends to meet new challenges," Progress in Polymer Science (Oxford), Dec. 2004. Elsevier Ltd GB, vol. 29, No. 12.pp. 1223-1248.

International Search Report and Written Opinion received for Patent Application No. PCT/GB2014/050848, dated Apr. 17, 2014. 10 pages.

GB Intellectual Property Office Search Report under Section 17(5) received for GB Patent Application No. 1305589.2 dated Sep. 30, 2013. 4 pages.

Extended European Search Report received from EP Patent Application No. 13275082.9 dated Sep. 5, 2013. 7 pages.

* cited by examiner

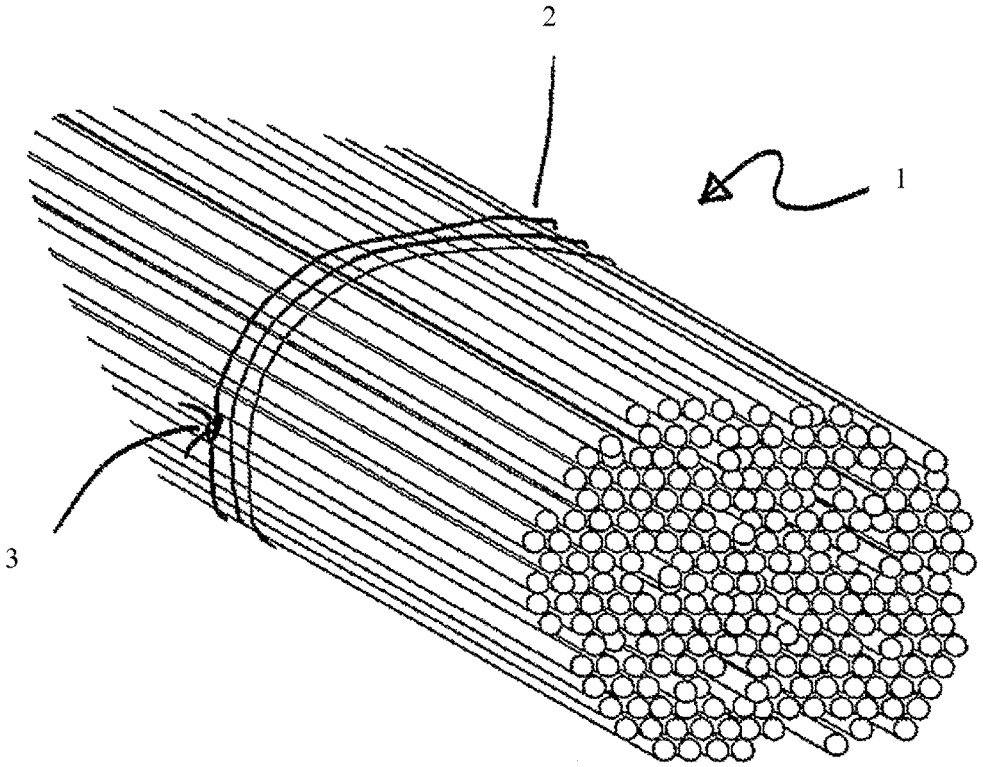
2
1
3

INSENSITIVE MUNITION PROPELLANTS

The invention relates to Insensitive Munition (IM) energetic materials particularly IM propellant compositions, and yet further to nitrocellulose-free IM propellants.

Low and high energy gun propellants and their energetic compositions are based on colloidal mixtures of nitroglycerine, nitrocellulose and nitroguanidine (also called picrite) in varying proportions, such as those discussed in GB2371297. The technology used to manufacture these materials has changed little in 100 years.

Colloidal compositions are, generally, classed as single, double, or, triple base compositions depending on the proportions of the major constituents present (i.e. one, two or three major components, respectively). Other components, e.g. nitramines, have been incorporated to increase the force constant or energy level of these compositions; colloidal compositions comprising three, or, more major components, may be referred to as multibase compositions.

Colloidal propellants, particularly for high energy applications, suffer from the disadvantage that they are highly vulnerable to unwanted ignition when in a hostile environment and subjected to attack by an energetic projectile, e.g. a projectile comprising a shaped warhead charge.

According to a first aspect of the invention there is provided an energetic composition suitable for use as a propellant comprising the following components in the following relative proportions:

component A of from 5% to 25% by weight of an IM energetic filler;

component B of from 50% to 80% by weight of a highly energetic filler, preferably comprising at least one nitramine compound;

component C of from 5% to 20% by weight of a binder; and component D of from 3% to 15% by weight of a plasticiser;

the percentages by weight of components A, B, C and D together with minor additives, if any, adding to 100%.

In compositions according to the present invention, component B provides the high energy capability of the composition. However it has advantageously been found that the addition of an IM energetic material, component A, present in the range of from 5-25% wt, provides a propellant that has an increased IM response to shaped charge attack. Recent trials of compounds defined herein have been shown to give a TYPE V reaction in response to a shaped charge attack.

Preferably, component A comprises of from 10% to 20% by weight, component B comprises of from 55% to 70% by weight, component C comprises of from 8% to 16% by weight and component D comprises of from 5% to 10% by weight of the said composition, the percentages adding to 100 percent.

Components C and D provides processability, enabling mixtures to be formed together with Components A and B and which may be worked into a suitable dough-like material which may be pressed, rolled or extruded to form suitable propellant products. The mutual combination of these components is specially selected in compositions according to the present invention because of the unexpected advantages such a combination provides as follows.

Compositions according to the present invention can be suitably processed to provide propellant materials, e.g. for use as gun or rocket propellants, especially gun propellants, which unexpectedly and beneficially can show an improved, i.e. reduced vulnerability over colloidal propellants, but without a corresponding decrease in energy normally associated with such an improvement.

The main properties which are desirable for a low vulnerability gun propellant, in addition to its reduced, vulnerability to shaped charge attack may be summarised as follows:

(1) a good practical propellant force; for example gun propellants for use in large calibre kinetic energy projectile applications or for use in artillery applications showing a force in the range of 820 KJ/kg to that of 1250 KJ per Kg or more.

(2) a low rate of burn desirably less than 80 mm per second; this allows stick propellants of reduced web size to be used;

(3) a low flame temperature desirably less than 3200K; this affords the possibility of reduced gun barrel erosion;

(4) the possibility of processing into a dough and extruding the dough using simple conventional processing solvents:

(5) the possibility of processing into a propellant product which shows little or no aeration with a density greater than 98%, preferably greater than 99 percent, of its theoretical maximum density; which results in a more dense and cohesive propellant matrix.

(6) low gas molecular weight, preferably in the range 20 to 22; enhancing the gas volume on ignition enhancing projectile velocity The propellant compositions embodying the invention are suitable for forming propellant products having unexpectedly all of aforementioned desirable properties.

The component A may be selected from a highly IM energetic filler, such as, for example, Nitrotriazolone (NTO), Hexanitrostilbene (HNS), Nitroguanidine (Picrite), Triaminotrinitrobenzene (TATB), Guarnylureadinitramide (FOX-12), 1,1-diamino 2,2-dinitro ethylene (FOX-7). The IM energetic filler is one which, without modification, has an FOI greater than 100. Many energetic fillers, including RDX and HMX may be modified, either via stabilisers or coatings such that they have a degree of IM compliance, and an FOI of greater than 100. The component A is selected from a material which is inherently IM, such as will have an FOI>100, without any processing or modification. It has been advantageously found that the inclusion of an IM energetic fill in the amount of from 5% to 25% by weight provides a final composition which has a high level of IM compliance.

Examples of preferred component B, high energy energetic filler are heteroalicyclic nitramines, such as for example RDX(cyclo-1,3,5-trimethylene, 2,4,6-trinitramine, cyclonite or Hexagen), HMX (cyclo-I,3,5,7-tetramethylene-2,4,6,8-tetranitramine, Octogen) or TATND (tetranitro-tetraminodecalin) and mixtures thereof. Other high energetic fillers may be TAGN, aromatic nitramines such as tetryl, ethylene dinitramine, and nitrate esters such as nitroglycerine (glycerol trinitrate), butane triol trinitrate or pentaerythrital tetranitrate, and inorganic perchlorates and nitrates such as ammonium perchlorate optionally together with metallic fuel such as aluminium particles.

The composition comprises component C, a binder and may be selected from a non-energetic binder and/or an energetic binder, present in the range of from 8 to 16% wt. Preferably the binder is a mixture of an energetic and non-energetic binder; more preferably the energetic binder is present in the range of from 5-10% by weight, non-energetic binder is present in the range of from 5-15% by weight, with a binder % wt in the range of from 8%-16% wt.

Examples of suitable non-energetic binder materials which may be blended with EVA (ethylene-vinyl acetate) are cellulosic materials such as esters, cellulose acetate, cellulose acetate butyrate, polyurethanes, polyesters, polybutadienes, polyethylenes, polyvinyl acetate and blends and/or copolymers thereof.

Examples of suitable energetic binder materials which may be used along side a non energetic binder, such as EVA are nitrocellulose, polyvinyl nitrate, nitroethylene, nitroallyl acetate, nitroethyl acrylate, nitroethy methacrylate, trinitroethyl acrylate, dinitropropyl acrylate, C-nitropolystyrene and its derivatives, polyurethanes with aliphatic C- and N-nitro groups, polyesters made from dinitrocarboxylic acids and dinitrodiol and homopolymers of 3-nitrato-3 methyl oxetane (PolyNIMMO).

The composition comprises component D, a plasticiser which may be selected from a non-energetic plasticiser and/or an energetic plasticiser. Preferably the plasticiser is a mixture of energetic and non-energetic plasticisers; yet more preferably when both are present the;

energetic plasticiser is present in the range of from 0-8% by weight, and non-energetic plasticiser is present in the range of from 2-10% by weight; such that the total plasticiser is preferably 5-10% wt, wherein the energetic plasticiser % wt is greater than the non-energetic plasticiser % wt.

Examples of energetic plasticisers may be Butyl NENA, GAP (glycidyl azide polymer), BDNPA/F (bis-2,2-dinitropropylacetol/formal), dimethylmethylene dinitroamine, bis (2,2,2-trinitropropyl)formal, bis(2,2,2-trinitroethyl)formal, bis (2-fluoro-2,2-dinitroethyl)formal, diethylene gylcol dinitrate, glycerol trinitrate, glycol trinitrate, triethylene glycol dinitrate, tetrethylene glycol dinitrate, trimethylolethane trinitrate, butanetriol trinitrate, or 1,2,4-butanetriol trinitrate.

Examples of known non-energetic plasticisers may be, Di Octyl adipate (DOA), Di Octyl Sebacate (DOS), dialkyl esters or sebacic adipic. or, triacetin, tricresyl phosphate, polyalkylene glycols and their alkyl ether derivatives, eg polyethylene glycol, polypropylene gycol, and diethylene glycol butyl ether.

Examples of minor additives may for example comprise one or more stabilisers, e.g. carbamite (N,N$^1$-diphenyl, NN$^1$-diethylurea) or PNMA (para-nitromethylmethoxyaniline); and/or one or more ballistic modifiers, e.g. carbon black or lead salts: and/or one or more flash suppressants, e.g. one or more sodium or potassium salts, e.g. sodium or potassium sulphate or bicarbonate and one or more binder-to-energetic filler coupling agents and one or more antioxidants.

Nitrocellulose is a very common energetic binder, however reproducibility of the cellulose source is a problem as it is commonly derived from natural sources. To ensure reproducibility of the final propellant, the source would preferably tightly controlled. It has very advantageously been found that in a highly preferred arrangement it is possible to remove the nitrocellulose, such that there is provided a non-nitrocellulose propellant composition, wherein component A comprises of from 8% to 12% by weight, component B comprises of from 65% to 75% by weight and component C comprises of from 8% to 12% by weight, wherein the non-energetic binder is present in the range of from 8%-12% by weight component D comprises of from 2%-10% energetic plasticiser is present in the range of from 3-8% by weight non-energetic plasticiser is present in the range of from 2-6% by weight, of the said composition, the percentages adding to 100%.

According to a further aspect of the invention there is provided a gun propellant comprising sticks or granules comprising a composition according to any one of the preceding claims.

Compositions according to the present invention may be processed into propellants by techniques which are known to those skilled in the art. The ingredients are incorporated in a suitable kneader to form a homogeneous composition. Eventually, the composition produced is pressed, rolled or extruded in the form of a dough-like material through suitably shaped extrusion dies. Extrusion may be carried out using a co-rotating twin screw extrusion machine.

Sticks are usually formed by cutting to suitable length rods or strands extruded through suitable dies giving a shape which could include a longitudinal slot. Granules are usually similarly formed by cutting to much shorter lengths rods or sticks obtained by extrusion. Normally, such granules have small holes, ego seven holes running lengthwise therethrough to provide suitable burning surfaces.

Particularly preferred compositions are outlined in Table 1, below.

TABLE 1

IM propellant compositions (*prior art compounds)
(n/r no results available)

| Component | Ingredient | Comp 503 % wt | Comp 519 % wt | Comp 516 % wt | Comp 521 % wt | Comp 424* % wt | Comp 463* % wt |
|---|---|---|---|---|---|---|---|
| component A | Nitroguanidine | 18.5 | 18.5 | 10 | 10 | — | — |
| component B | RDX | 56 | — | | 70 | | |
| component B | HMX | — | 56 | 70 | — | 74.5 | 74.5 |
| component C | EVA | 7 | 7 | 11 | 11 | 7 | |
| component C | Nitrocellulose | 8.5 | 8.5 | — | — | 8.5 | 8.5 |
| component D | Butyl NENA | 6 | 6 | 5 | 5 | | |
| component D | DOA | 3 | 3 | 4 | 4 | | 9 |
| component D | DBP | | | | | 9 | |
| minor | carbamite | 1 | 1 | — | — | 1 | 1 |
| SCJ attack response Type | | V | V | n/r | n/r | III/IV | III/IV |

Experimental Trial

Several compositions in Table 1 were subjected to a test set-up in accordance with STANAG 4526, namely response to a shaped charge attack. The response was measured by taking into account the combined evidence from blast overpressure results, witness plate damage observed and from propellant debris observations.

The response of compounds 503 and 519, which are compounds according to the invention (contain component A) were measured as undergoing a TYPE V reaction. This is a very low response to the external stimulus.

The prior art compounds, 424 and 463 contain largely the same compounds, but do not have an IM filler present, ie component A. It was observed that the IM response was III/IV, which is a much more violent response compared to that of the compounds of the invention.

Whilst the invention has been described above, it extends to any inventive combination of the features set out above, or in the following description, drawings or claims.

Exemplary embodiments of the device in accordance with the invention will now be described. with reference to the accompanying drawings in which:—

FIG. 1 shows a three-dimensional representation of a bundle of propellant sticks Turning to FIG. 1 there is provided an end portion of a bundle 1 of a plurality of propellant sticks 2. A resilient ligature 3 has been wound around the plurality of sticks 2 three times using a tying machine (not shown). The securing of the ligature 3 may be afforded by using a knot and subsequently cutting the ligature 3. Further ligatures may be applied to other distinct circumferences and in fact it may be preferred to have at least two ligatures applied at distinct circumferences in order to prevent the propellant sticks 2 from splaying.

The invention claimed is:

1. An energetic non-nitrocellulose composition suitable for use as a propellant comprises the following components in the following relative proportions:

component A: of from 8% to 12% by weight of an Insensitive Munition (IM) energetic filler, wherein component A is at least one of Nitrotriazolone (NTO), Hexanitrostilbene (HNS), Nitroguanidine (Picrite), and Triaminotrinitrobenzene (TATB);

component B: of from 65% to 75% by weight of a highly energetic filler comprising at least one nitramine compound;

component C: of from 8% to 16% by weight of a binder, wherein the binder includes a non-energetic binder; and component D: of up to 10% by weight of a plasticiser, which includes an energetic plasticiser present in the range of from 3%-8% by weight and a non-energetic plasticiser present in the range of from 2%-6% by weight, wherein the percentages by weight of components A, B, C and D together with minor additives, if any, adding to 100%.

2. An energetic composition suitable for use as a propellant comprises the following components in the following relative proportions:

component A: of from 10% to 20% by weight of an Insensitive Munition (IM) energetic filler, wherein component A is at least one of Nitrotriazolone (NTO), Hexanitrostilbene (HNS), Nitroguanidine (Picrite), and Triaminotrinitrobenzene (TATB);

component B: of from 55% to 70% by weight of a highly energetic filler comprising at least one nitramine compound;

component C: of from 10% to 16% by weight of a binder, wherein the binder comprises a non-energetic binder and an energetic binder, and the energetic binder is present in the range of from 5-10% by weight, and the non-energetic binder is present in the range of from 5-15% by weight; and component D: of from 5% to 10% of a plasticiser, wherein the plasticiser comprises at least one of a non-energetic plasticiser and an energetic plasticiser, and the energetic plasticiser is present up to 8% by weight, and the non-energetic plasticiser is present in the range of from 2%-10% by weight, wherein the percentages by weight of components A, B, C and D together with minor additives, if any, adding to 100%.

3. A gun propellant comprising sticks or granules comprising a composition according to claim 1.

4. An energetic composition, according to claim 2, wherein component B comprises 65% to 70% by weight, component C comprises 8% to 12% by weight, and component D comprises an energetic plasticiser present in the range of from 3%-8% by weight and a non-energetic plasticiser present in the range of from 2%-6% by weight.

5. A gun propellant comprising sticks or granules comprising a composition according to claim 2.

6. An energetic composition suitable for use as a propellant comprises the following components in the following relative proportions:

component A: of from 5% to 25% by weight of an Insensitive Munition (IM) energetic filler selected from at least one of Nitrotriazolone (NTO), Hexanitrostilbene (HNS), Nitroguanidine (Picrite), and Triaminotrinitrobenzene (TATB);

component B: of from 50% to 80% by weight of a highly energetic filler comprising at least one nitramine compound;

component C: of from 5% to 20% by weight of a binder, wherein the binder comprises a mixture of a non-energetic binder and an energetic binder, with the energetic binder being present in the range of from 5-10% by weight, and the non-energetic binder being present in the range of from 5-15% by weight; and component D: of from 3% to 15% of a plasticiser, wherein the plasticiser comprises a mixture of a non-energetic plasticiser and an energetic plasticiser with the energetic plasticiser being present up to 8% by weight, and the non-energetic plasticiser being present in the range of from 2%-10% by weight, wherein the percentages by weight of components A, B, C and D together with minor additives, if any, adding to 100%.

7. A gun propellant comprising sticks or granules comprising a composition according to claim 6.

8. An energetic composition suitable for use as a propellant comprises the following components in the following relative proportions:

component A; of from 5% to 25% by weight of an IM energetic filler;

component B: of from 70% to 80% by weight of a highly energetic filler comprising at least one nitramine compound;

component C: of from 10% to 20% by weight of a binder comprising a mixture of a non-energetic binder present in the range of from 5-15% by weight and an energetic binder of in the range of from 5-10% by weight; and component D: of from 3% to 15% by weight of a plasticiser wherein, the plasticiser is a mixture of a non-energetic plasticiser and an energetic plasticiser, and the energetic plasticiser is present up to 8% by weight, and the non-energetic plasticiser is present in the range of from 2%-10% by weight, wherein the percentages by weight of components A, B, C and D together with minor additives, if any, adding to 100%, provided that component C is other than nitrocellulose.

9. A composition according to claim 8, wherein:

component A comprises of from 10% to 20% by weight, component B comprises of from 55% to 70% by weight, component C comprises of from 8% to 16% by weight and component D comprises of from 5% to 10% by weight of the said composition, together with any minor additives, if any, the percentages adding to 100%.

10. An energetic non-nitrocellulose composition according to claim 1, wherein component A comprises Picrite.

11. An energetic non-nitrocellulose composition according to claim 1, wherein component B comprises RDX.

12. An energetic non-nitrocellulose composition according to claim 1, wherein component C comprises EVA.

13. An energetic non-nitrocellulose composition according to claim 1, wherein component D comprises butyl NENA.

14. An energetic composition according to claim 2, wherein component A comprises Picrite.

15. An energetic composition according to claim 2, wherein component B comprises RDX.

16. An energetic composition according to claim 2, wherein component C comprises EVA.

17. An energetic composition according to claim 2, wherein component D comprises butyl NENA.

18. An energetic composition according to claim 6, wherein component A comprises Picrite.

19. An energetic composition according to claim 6, wherein component B comprises RDX.

20. An energetic composition according to claim 6, wherein component C comprises EVA.

21. An energetic composition according to claim 6, wherein component D comprises butyl NENA.

* * * * *